United States Patent [19]

Shimbo et al.

[11] Patent Number: 4,857,959

[45] Date of Patent: Aug. 15, 1989

[54] METHOD AND APPARATUS OF CHARGING FOR TRANSFER IN ELECTROPHOTOGRAPH DEVICE

[75] Inventors: Kazuyuki Shimbo, Kanagawa; Katsuhiko Nishimura, Yamaguchi, both of Japan

[73] Assignee: Asahi Kogaku kogyo K.K., Tokyo, Japan

[21] Appl. No.: 19,432

[22] Filed: Feb. 26, 1987

[30] Foreign Application Priority Data

Feb. 28, 1986 [JP] Japan ..... 61-43393

[51] Int. Cl.[4] ..... G03G 15/00

[52] U.S. Cl. ..... 355/276

[58] Field of Search ..... 355/3 CH, 14 CH, 14 D, 355/3 TR, 14 TR, 3 DD, 3 R

[56] References Cited

U.S. PATENT DOCUMENTS 3,496,351 2/1970 Cunningham, Jr. ..... 355/3 CH
3,564,239 2/1971 Kushima ..... 355/3 CH X
4,239,373 12/1980 Weikel, Jr. ..... 355/14 CH
4,348,100 9/1982 Snelling ..... 355/14 D
4,565,436 1/1986 Okada et al. ..... 355/3 CH X

FOREIGN PATENT DOCUMENTS 55-44280 3/1980 Japan .

OTHER PUBLICATIONS

Abstract of the above cited Japanese Publication for "Charging Method" by Touichi Matsumura, published Mar. 28, 1980—pp. 144 E 13.

*Primary Examiner*—A. T. Grimley
*Assistant Examiner*—Ed Pipala
*Attorney, Agent, or Firm*—Sandler & Greenblum

[57] ABSTRACT

A charging method for transfer in an electrograph device having a phtosensitive drum uses a high voltage pulse train applied to a displaceable transferring sheet to effect transfer to the sheet of an image on the photosensitive drum. A detector for detecting the speed of feed of the sheet controls the frequency of the voltage pulse train so that the number of pulses per unit displacement of the sheet is independent of the speed at which the sheet moves.

12 Claims, 3 Drawing Sheets

METHOD AND APPARATUS OF CHARGING FOR TRANSFER IN ELECTROPHOTOGRAPH DEVICE

BACKGROUND OF THE INVENTION

1. Field of the Invention

The present invention relates to a charging method and apparatus for transfer in an electrophotograph device.

2 Description of the Related Art

In an electrophotograph device, an electrostatic latent image is formed on a photosensitive body (electrographic recording medium) such as a uniformly charged selenium drum. Toner, of a predetermined color (including black), is charged with charges homopolar to the charged selenium drum, and then applied to the electrostatic latent image to develop it. The developed colored toner is then transferred onto an object (which will be referred to hereinafter as a transferring object), such as plain paper copier (PPC) sheet, e.g., a sheet of paper, by moving the transferring object past a charger operatively positioned relative to the object. This electrophotographic technology is widely used, for example, in image processing apparatus, such as copying machines or transfer type of facsimiles.

In the prior art, the transferring object is continuously charged by applying a constant direct-current high voltage to the charger as the object moves therepast. Accordingly, the charge per unit area of the transferring object fluctuates in accordance with large or rapid changes in speed of the transferring object past the charger. This change in the amount of charge decreases transfer efficiency, and also produces unclear or blurred images.

In a transferring charging process, the transferring object is charged with a polarity different from the charge of the toner applied to the latent image formed on the electrographic recording medium, so that the toner is transferred from the medium onto the transferring object. For example, when the transferring object is fed at relatively high speed, the transferring object may not be charged sufficiently resulting in an incomplete transfer of toner.

On the contrary, when the transferring object is fed at relatively low speed, the transfer charges are injected through the transferring object into the toner thereby changing the polarity of the toner charge to the polarity of the charge applied to the transferring object. This results in separation of the toner applied to the transferring object. In particular, if movement of the transferring object stops, then the possibly of injecting charges into the toner and, consequently, the separation of the toner from the transferring object becomes large.

SUMMARY OF THE INVENTION

An object of the present invention, therefore, is to provide improved method and apparatus of charging for transfer which overcomes the aforementioned drawbacks and which ensures a reliable transfer regardless of the speed at which the transferring object is fed. In order to achieve the object mentioned above, the present invention features that the transferring object is charged by applying to a charger, voltage pulses having a frequency that varies in accordance with the speed of feed of the transferring object rather than by applying a uniform charge to the transferring object.

According to an aspect of the present invention, apparatus of charging for transfer comprises means for forming an electrostatic latent image on an electrographic recording medium by charging the medium, developing means for applying charged toner to the medium, the polarity of charge on the toner being the same as the polarity of charge on the medium, and charging means for applying a transferring voltage to a transferring object for charging the same with charges whose polarity is different from the polarity of charges on the applied toner, the improvement comprising means for detecting the speed of the movement of either the transferring object or the electrographic recording medium, and means for applying to said charging means voltage pulses having a frequency functionally related to the detected speed.

When the transferring object is fed at a high speed, the frequency of pulses applied to said charging means increases for a predetermined period of time; and when the transferring object is fed at a low speed, the frequency of pulses applied to said charging means decreases. In other words, one pulse of voltage is applied to the transferring object for the same displacement thereof regardless of its speed, and the density of charge on the transferring object remains constant and substantially independent of the speed of the transferring object.

BRIEF DESCRIPTION OF THE DRAWINGS

The invention is described in detail below with reference to the accompanying drawings, in which.

DESCRIPTION OF PREFERRED EMBODIMENTS

Figure 1:
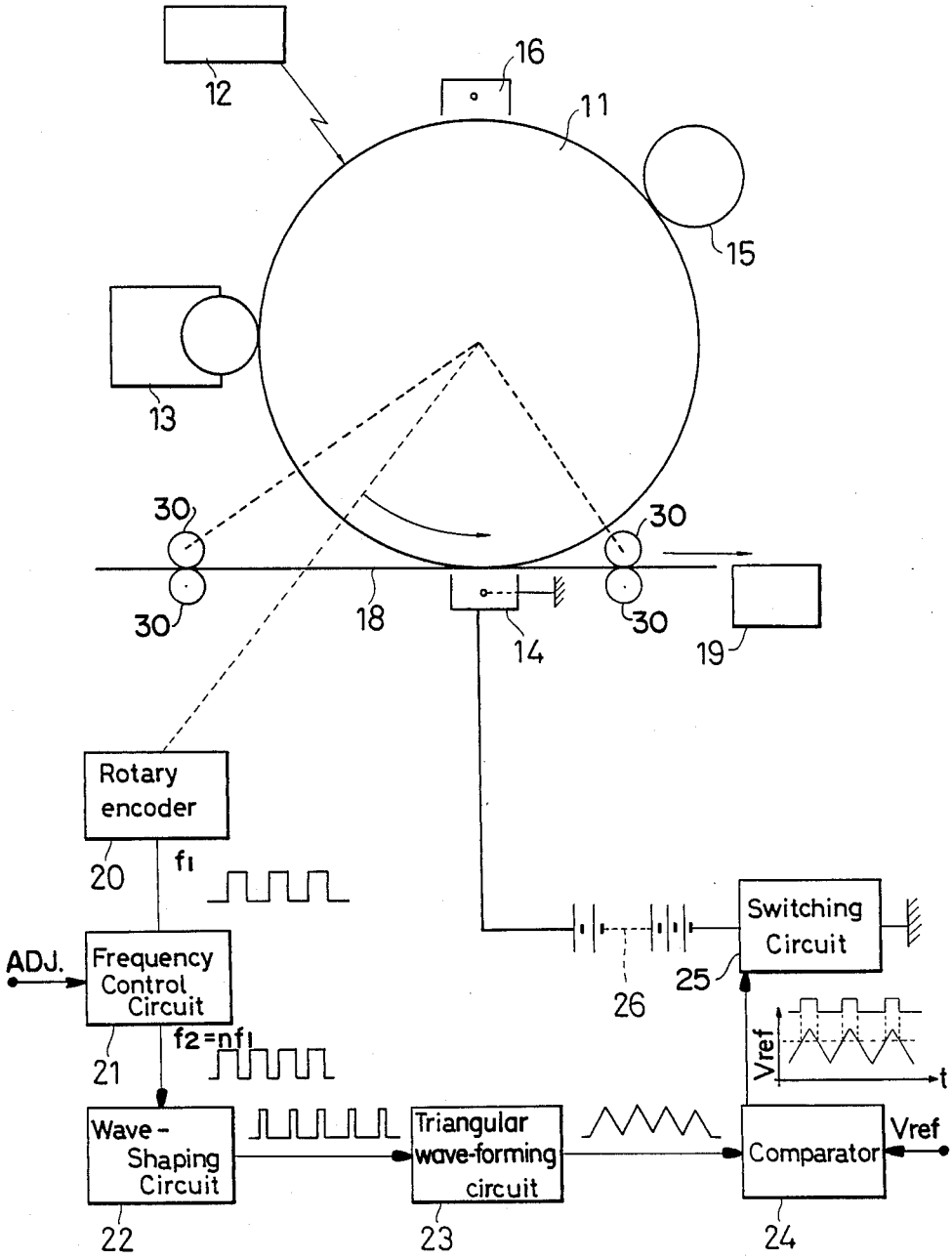
FIG. 1 is a schematic diagram of charging apparatus according to the present invention.

Referring now to FIG. 1, arranged around the periphery of a photosensitive drum (electrographic recording medium), such as selenium drum 11, in the order determined by the arrow that indicates the direction of rotation of the drum, are the following components: charger 16 for uniformly charging the drum; image forming unit 12 for forming an electrostatic latent image on the drum; developing unit 13 for applying charged toner to the drum; transferring charger (corona discharging unit) 14 for effecting a transfer of toner from the drum to sheet 18; and cleaning brush 15 for removing excess toner from the drum.

Selenium drum 11 is uniformly charged with positive (or negative) charges by charger 16. When a light beam modulated with image data produced by electrostatic latent image forming unit 12 is incident upon charged selenium drum 11, changes in charge are produced on areas of the selenium drum that directly receive light beams in such a way as to locally decrease the amount of charge in such areas. In other words, an electric potential difference exists between an area of the selenium drum upon which the light beam is incident and the remaining area of the selenium drum, thus forming an electrostatic image. Subsequently, developing unit 13 feeds toner, which has positive (or negative) charge identical to the polarity of charge on the selenium drum, together with a carrier, onto the surface of selenium drum 11 so that the latent image on the drum is developed.

Transferring charger 14 charges the PPC sheet (paper) 18 with charge having a polarity opposite to the polarity of charge on the toner thus causing toner carried by selenium drum 11 to be transferred to sheet 18. Toner transferred to PPC sheet 18 is then fixed by a fixing unit 19.

Residual toner on selenium drum 11 is removed therefrom by means of cleaning brush 15. Charger 16 for the photosensitive body charges the selenium drum 11 so that the surface of drum 11 is uniformly charged to an initial positive (or negative) polarity.

In the electrophotographic apparatus according to the present invention, PPC sheet 18 is charged by voltage pulses applied thereto by means of transferring charger 14. The frequency of these voltage pulses varies in accordance with the feeding speed of PPC sheet 18, and/or the rotational speed of selenium drum 11. As shown in FIG. 1, pairs of feed rollers 30 engage sheet 18 and feed the same into operative contact with drum 11. The rotational speed of these rollers and the rotational speed of drum 11 are synchronized in a conventional manner.

An energizing circuit for impressing high voltage pulses on transferring charger 14 is shown in FIG. 1. The circuit includes rotary encoder 30 that produces a predetermined number of pulses per unit time in accordance with the rotational speed (number of revolutions) of selenium drum 11. Alternatively, encoder 20 can be driven by rollers 30, there being a fixed relationship between the rotational speed of the rollers and that of the drum. The pulses output from rotary encoder 20 are fed to wave-shaping circuit 22 through frequency-to-frequency control circuit 21 which optimizes the frequency of the pulses in accordance with the rotational speed of selenium drum 11. The optimum frequency usually will be different from the frequency of the pulses produced by rotary encoder 20. Frequency control circuit 21 is, for example, composed of a frequency multiplier and/or a frequency divider (demultiplier) in combination, as is well known.

The pulse signal issued by wave-shaping circuit 22 is directly proportional to the rotational speed of selenium drum 11, and to the linear speed of sheet 18. Circuit 21 functions to make a direct proportional relationship represented by $f2=n\ f1$ between f1 and f2, where $n>0$, f1 is the frequency of pulses provided by encoder 20, and f2 is the frequency of pulses provided by circuit 21. When f1 is smaller than the on-off frequency of the voltage to be applied to charger 14, circuit 21 produces and issues an increased frequency f2 which is larger than f1 inputted into circuit 21($n\geqq 1$). On the contrary, when f1 is larger than the on-off frequency of the voltage to be applied to charger 14, circuit 21 produces and issues a decreased frequency f2 which is smaller than f1 inputted to the circuit 21($n<1$). The frequency f2 is always equal to the on-off frequency of the voltage actually applied to charger 14. The value of n, the constant of proportionality between f1 and f2 is manually variable.

The pulse train produced by circuit 22 is converted to a triangular wave signal by means of triangular waveforming circuit 23. The triangular wave signal is compared with reference voltage Vref in comparator 24. When the wave signal is larger than the reference voltage Vref, comparator 24 turns on switching circuit 25 applying high voltage power source 26 to transferring charger 14. In other words, a high voltage pulse train, having a frequency in accordance with the rotational speed of selenium drum 11, is applied to transferring charger 14. A train of transferring high voltage pulses is thus applied to PPC sheet 18 which moves together with and along the periphery of selenium drum 11. The width of the voltage pulses, or stated otherwise, the duty cycle of the pulses applied to charger 14, can be adjusted by adjusting the reference voltage Vref in comparator 24.

Thus, according to the present invention, a train of high voltage pulses having a frequency in accordance with the speed of feed of the transferring object, i.e., the PPC sheet 18, is applied to the PPC sheet. This prevents excess transferring voltage from being applied to PPC sheet 18 if the sheet speed is drastically reduced in order to prevent injection of charges into the toner which would otherwise take place in the conventional uniform charging as mentioned before. As a consequence, no failure of transfer occurs. Also, there is no lack of transferring high voltage. Because the frequency and the pulse width of the high pulse voltage for transfer can be controlled by adjusting the constant of proportionality of frequency control circuit 21, and by adjusting the level of $V_{ref}$ input to comparator 24, respectively, optimum frequency and pulse width can be easily selected, depending on the kind of the transferring object 18 (e.g., thickness or width of the sheet, continuous sheet of separate sheets, etc.).

In the illustrated embodiment, the actual number of revolutions of selenium drum 11, and accordingly the actual speed of feed of PPC sheet 18, are detected by rotary encoder 20. Thus, precise control can be effected without using an expensive pulse motor as a driving motor of selenium drum 11. Thus, a relatively inexpensive motor, such as a synchronous motor or DC servomotor can be used to rotate selenium drum 11 and drive rollers 300 in the present invention.

Figure 2:
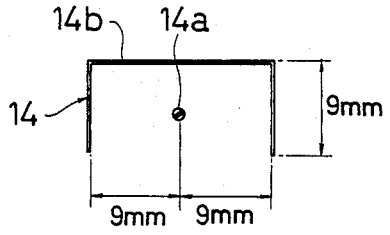
FIG. 2 is a sectional view of a charger shown in FIG. 1.

In the following examples of the present invention, transferring charger 14 had a configuration shown in FIG. 2. Charger 14 had center electrode **14*a* and peripheral electrode 14*b*. The diameter of center electrode 14*a* was 100 μm. The pulse frequency was set by frequency control circuit 21**, and the pulse width was set by reference voltage Vref.

Characteristics of the components of the apparatus, such as the selenium drum 11 etc. were as follows:

Selenium drum (amorphous selenium): positive polarity;

Toner: negative polarity (black), mean particle size=10 μm;

Carrier: pure powdered iron, mean particle size=70 μm.

EXAMPLE 1

The PPC sheet was fed at a relatively high speed.

Speed of feed of the PPC sheet 18: 20 mm/sec.

Pulse width of voltage applied to the charger 14: 50 ms

Pulse frequency: 5 Hz

Pulse voltage: 6.1 Kv (peak value)

Figure 3:
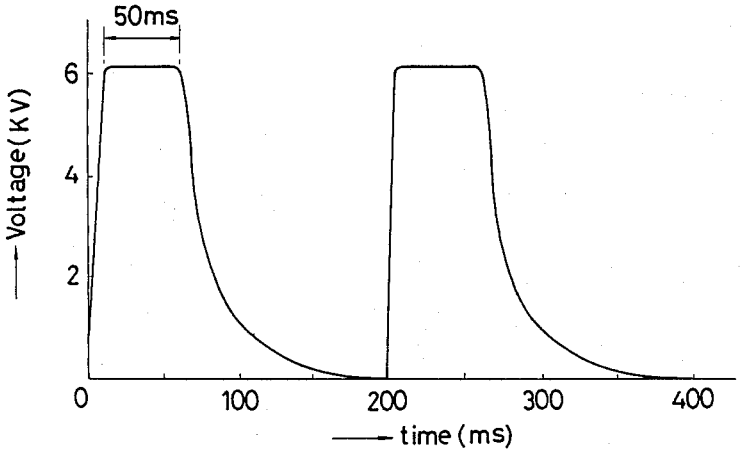
FIGS. 3 to 5 are views showing different wave shapes of a voltage pulse train used in the present invention.

The wave shape of the pulses used in the Example 1 is shown in FIG. 3. It has been confirmed experimentally that the high voltage applied to the transferring charger 14 caused a good transfer of a clear image to the PPC sheet 18 which moved at a relatively high speed.

EXAMPLE 2

The PPC sheet was fed at a very low speed.

Speed of feed of the PPC sheet: 1 mm/sec.

Pulse width: 5 ms
Pulse frequency: 1~100 Hz
Pulse voltage: 6.1 Kv (peak value)

Figure 4:
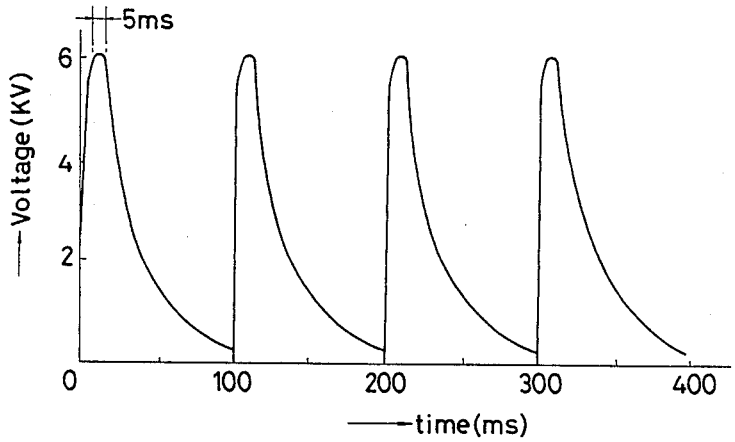

A pulse frequency of 100 Hz connotes that the peak value (6.1 kv) of voltage was continuously applied. The wave shape of the pulses (pulse frequency is 10 Hz) is shown in FIG. 4.

In this example, a good transfer of the toner image was obtained in the range of 1 Hz~10 Hz for the pulse frequency. However, when the pulse frequency exceeded 20 Hz, failure of transfer occurred.

In other words, it has been found that when the speed of feed of the PPC sheet is very low, the frequency of the pulse voltage should be limited to a certain lower limit and preferably the pulse width should be small. Accordingly, when the speed of feed of the PPC sheet is very low, as mentioned above, the pulse frequency should be set within 1 Hz~10 Hz by means of the pulse frequency control circuit 21.

EXAMPLE 3

The PPC sheet 18 was fed at a relatively high speed, and the pulse width was relatively small. The pulse frequency was varied.

Speed of feed of the PPC sheet 18: 20 mm/sec.
Pulse width: 5 ms
Pulse frequency: 1~100 Hz
Pulse voltage: 6.1 Kv (peak value)

A pulse frequency of 100 Hz connotes that the peak value (6.1 Kv) of voltage was continuously applied.

In this example, it has been confirmed that a good transfer of the toner image was obtained when the pulse frequency was within 10 Hz~20 Hz, and that the transfer efficiency was decreased when the pulse frequency was not in the range of 10 Hz~20 Hz. Accordingly, it has been found that when the speed of feed of the PPC sheet is relatively high, the frequency should be set to be within 10 Hz~20 Hz by the frequency control circuit 21.

EXAMPLE 4

In this example, the pulse frequency was constant and the pulse width was varied to examine a possible influence on the transfer efficiency by the pulse width.

Speed of feed of the PPC sheet 18: 20 mm/sec.
Pulse width: 5 ms, 50 ms, and 100 ms.
Pulse frequency: 5 Hz
Pulse voltage: 6.1 Kv (peak value)

Figure 5:
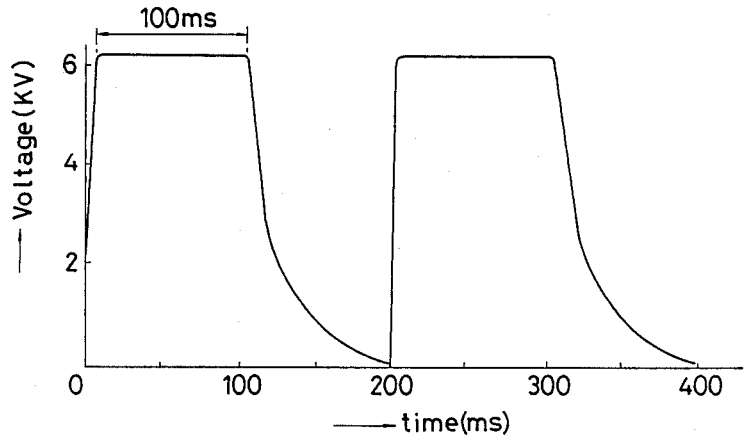

The wave shape of the pulse voltage at 100 ms of pulse width shown in FIG. 5. The wave shapes of the pulses at 5 ms and 50 ms of pulse width are same as those shown in FIGS. 4 and 3, respectively.

In example 4, it has been confirmed that good transfer efficiency was obtained only when the pulse width was 50 ms, and a failure of transfer occurred when the pulse widths were 5 ms and 100 ms.

From these experimental results, it has been found that the pulse width has a large influence on the transfer efficiency. The pulse width can be set to an optimum value by adjusting the reference voltage Vref, as mentioned hereinbefore.

It goes without saying that the present invention is also applicable to a negative polar electrophotographic recording medium (e.g., organic optical conductor) and a positive polar toner. It should be also appreciated that the wave shapes of the pulse voltage used in the invention are not limited to those illustrated in the drawings.

In addition, the present invention can be applied not only to an indirect charging by the corona discharge as mentioned above, but also to a direct charging in which a direct transfer takes place with the help of rollers.

We claim:

1. An electrophotograph device comprising:

(a) means for forming an electrostatic latent image on an electrographic recording medium uniformly charged with charges of a given polarity;

(b) developing means for applying toner charged with a predetermined polarity of charges to said medium in order to develop said electrostatic latent image;

(c) means for charging a movable transferring object which is operatively associated with said medium with a predetermined polarity of charges in order to transfer toner from said medium to said transferring object;

(d) means for moving said movable transferring object at variable speeds;

(e) means for detecting the speed of movement of said transferring object;

(f) means for generating a pulse train having a frequency which is proportional to the speed of movement of said transferring object which is detected by said detecting means; and (g) means for receiving said pulse train and means for applying transferring voltage pulses to said transferring object, in response to the frequency of the pulse train received, at a frequency which is proportional to said speed of movement.

2. Apparatus according to claim 1 wherein said detecting means comprises a rotary whose output signal is a pulse train of a frequency determined in accordance with the detected speed of the transferring object.

3. Apparatus according to claim 2 wherein said means for applying transferring voltage pulses comprises a switching circuit for selectively applying a high voltage to said means for charging, and a control circuit that controls the operation of the switching circuit in response to the output signal of the rotary encoder.

4. Apparatus according to claim 1 wherein the electrographic recording medium is a rotating photosensitive drum.

5. Apparatus according to claim 4 wherein said detecting means comprises a rotary encoder whose output signal is a pulse train of a frequency determined in accordance with the detected speed of the transferring object.

6. Apparatus according to claim 5 wherein said means for applying transferring voltage pulses comprises a switching circuit for selectively applying a high voltage to said means for charging, and a control circuit that controls the operation of the switching circuit in response to the output signal of the rotary encoder.

7. Apparatus according to claim 4 wherein the transferring object is a paper sheet.

8. Apparatus according to claim 7 wherein said detecting means comprises a rotary encoder whose output signal is a pulse train of a frequency determined in accordance with the detected speed of the transferring object.

9. Apparatus according to claim 8 wherein said means for applying transferring voltage pulses comprises a switching circuit for selectively applying a high voltage to said means for charging, and a control circuit that controls the operation of the switching circuit in response to the output signal of the rotary encoder.

10. An electrophotograph device comprising:

(a) means for forming an electrostatic latent image on an electrographic recording medium uniformly charged with charges of a given polarity;

(b) developing means for applying toner charged with charges of the same polarity as said electrostatic recording medium to said medium in order to develop said electrostatic latent image;

(c) means for charging a movable transferring object which is operatively associated with said medium with charges of a polarity which is different from the polarity of the charged electrostatic recording medium in order to transfer toner from said medium to said transferring object;

(d) means for moving said movable transferring object at variable speeds;

(e) means for detecting the speed of movement of said transferring object;

(f) means for generating a pulse train having a frequency which is proportional to the speed of movement of said transferring object which is detected by said detecting means; and (g) means for receiving said pulse train and means for applying transferring voltage pulses to said transferring object, in response to the frequency of the pulse train received, at a frequency which is proportional to said speed of movement, wherein said detecting means comprises a rotary encoder which outputs a signal, in the form of said pulse train having a frequency determined in accordance with the detected speed of said transferring object, said pulse train being outputted to a frequency control circuit and a wave shaping circuit, said wave shaping circuit comprising means for outputting a generally rectangular wave to a triangular wave forming circuit, said triangular wave forming circuit, in turn, comprising means for outputting a triangular wave form to a comparator which compares said triangular wave to a reference voltage inputted into said comparator, said apparatus further comprising a switching circuit for thereafter selectively applying high voltage pulses at a controlled frequency to said means for charging.

11. An electrograph device comprising:

(a) means for forming an electrostatic latent image on a photosensitive drum and for charging said photosensitive drum uniformly with charges of a predetermined polarity;

(b) a developing unit for applying toner charged with charges of said predetermined polarity to said drum in order to develop said electrostatic latent image;

(c) a transferring charger for charging a movable paper sheet operatively associated with said drum in order to charge said sheet with charges of a polarity which is different from the polarity of said drum in order to transfer toner from said drum to said paper sheet;

(d) means for moving said paper sheet at variable speeds;

(e) a rotary encoder for detecting the speed of movement of said paper sheet, said rotary encoder comprising means for outputting a signal in the form of a pulse train of a frequency which is established in response to the detected speed of movement of said paper sheet, said rotary encoder comprising means for outputting said pulse train to a frequency control circuit which in turn comprises means for outputting a signal to a wave shaping circuit, said wave shaping circuit comprising means for outputting a generally rectangular wave to a triangular wave forming circuit, said triangular wave forming circuit in turn comprising means for outputting a triangular wave to a comparator which compares the triangular wave to a reference voltage inputted into said comparator; and (f) a switching circuit for selectively applying high voltage pulses at a controlled frequency to said charging means, said controlled frequency being proportional to the speed of movement of the paper sheet.

12. An electrographic device comprising:

(a) means for forming an electrostatic image on an electrographic recording medium uniformly charged with charges of a given polarity;

(b) developing means for applying toner charged with a predetermined polarity of charges to said medium in order to develop said electrostatic latent image;

(c) means for charging a movable transferring object which is operably associated with said medium with a predetermined polarity of charges in order to transfer toner from said medium to said transferring object;

(d) means for moving said movable transferring object at variable speeds;

(e) means for detecting the speed of movement of said transferring object;

(f) means for generating a pulse train having a frequency which is proportional to the speed of movement of said transferring object which is detected by said detecting means; and (g) means for receiving said pulse train and means for applying transferring voltage pulses to said transferring object, in response to the frequency of the pulse train received, at a frequency which is proportional to said speed of movement, wherein said detecting means comprises a rotary encoder which outputs a signal, in the form of said pulse train having a frequency determined in accordance with the detected speed of said transferring object, said pulse train being outputted to a frequency control circuit and a wave shaping circuit, said wave shaping circuit comprising means for outputting a generally rectangular wave to a triangular wave forming circuit, said triangular wave forming circuit, in turn, comprising means for outputting a triangular wave form to a comparator which compares said triangular wave to a reference voltage inputted into said comparator, said apparatus further comprising a switching circuit for thereafter selectively applying high voltage pulses at a controlled frequency to said means for charging.

* * * * *